United States Patent [19]

Baumann

[11] Patent Number: 4,644,709

[45] Date of Patent: Feb. 24, 1987

[54] OMNIFORM BUILDING SYSTEM

[75] Inventor: Hanns U. Baumann, Laguna Beach, Calif.

[73] Assignee: Sharon K. Baumann Trust, Laguna Beach, Calif.

[21] Appl. No.: 729,747

[22] Filed: May 2, 1985

[51] Int. Cl.[4] ..... E04B 1/34

[52] U.S. Cl. ..... 52/79.14; 52/127.2; 52/745; 52/749

[58] Field of Search ..... 52/745, 70, 127.2, 79.1, 52/79.5, 127.1, 125.6, 125.1, 79.14, 747, 744, 749; 248/248.3; 249/210, 18, 13; 425/59, 63

[56] References Cited

U.S. PATENT DOCUMENTS

| | | | |
|---|---|---|---|
| 3,006,592 | 10/1961 | Davis | 248/354.3 |
| 3,030,061 | 4/1962 | Jennings | 248/354.3 |
| 3,171,627 | 3/1965 | Tapley | 248/354.3 |
| 3,407,560 | 10/1968 | Baumann | 52/645 |
| 3,494,092 | 2/1970 | Johnson | 52/745 |
| 3,710,534 | 1/1973 | McNamara | 52/745 |
| 3,744,196 | 7/1973 | Weese | 52/745 |
| 3,751,864 | 8/1973 | Berger et al. . | |
| 3,757,477 | 9/1973 | McCrillis et al. . | |
| 3,849,952 | 11/1974 | Hanaoka . | |
| 3,880,394 | 4/1975 | Wisecarver | 248/354.3 |
| 3,940,903 | 3/1976 | Gunkel | 52/745 |
| 3,990,193 | 11/1976 | Ray et al. . | |
| 4,023,315 | 5/1977 | Stucky | 52/79.13 |
| 4,045,937 | 9/1977 | Stucky | 52/745 |
| 4,168,052 | 9/1979 | Calderaro | 249/210 |
| 4,425,741 | 1/1984 | Ronai | 52/70 |
| 4,447,996 | 3/1984 | Maurer, Jr. et al. . | |
| 4,525,975 | 7/1985 | McWelty | 52/745 |

FOREIGN PATENT DOCUMENTS

| | | | |
|---|---|---|---|
| 960842 | 1/1975 | Canada | 249/210 |
| 490927 | 5/1976 | U.S.S.R. | 52/71 |

OTHER PUBLICATIONS

Engineering News Record, Apr. 15, 1976, pp. 97 and 98.

Sweet's Catalog File 1979, 3.5 Pat pp. 4 and 5.

*Primary Examiner*—John E. Murtagh

*Attorney, Agent, or Firm*—James W. Lucas

[57] ABSTRACT

A prefabricated building module can be essentially completed before transporting to the erection site. Thin walls, along with structural floor and ceiling, are fabricated on a plane aligned with the floor, and interconnected with hinges. After complete finishing of interior surfaces, such as wallpapering and carpeting, the ceiling and both walls are hinged into their final positions, along with temporary external strong-back forms as strong-backs. Internal soft-faced bracing sections are erected to support both walls before removal of the external strong-back forms. This bracing allows the completed module to be transported and craned to the upper floors of a multi-story building. The unit is light enough to allow knocked-down furniture to be carried inside.

The module includes external welded wire fabric or reinforcement bars that will serve to tie adjacent units together, when concrete is poured between them to form a common wall. The reusable internal bracing resists the pressure of the concrete while it is being poured, and is later removed by collapsing and passing through a doorway.

8 Claims, 9 Drawing Figures

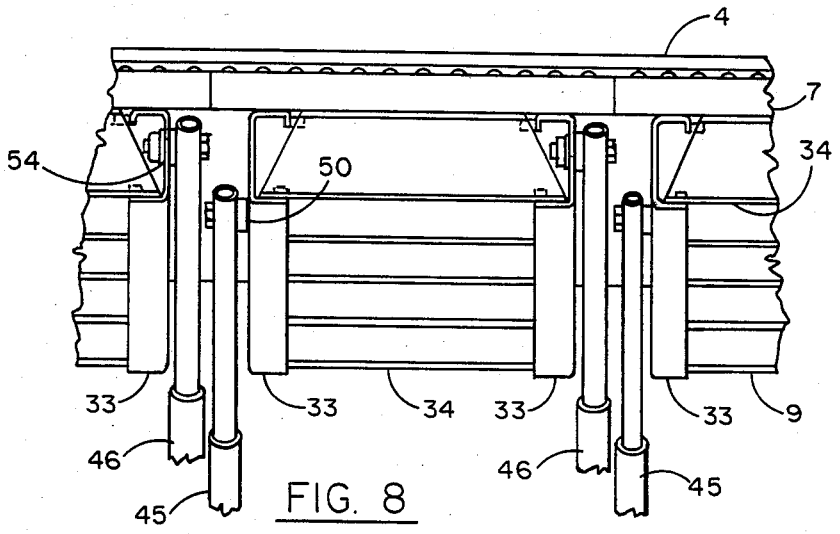
FIG. 8
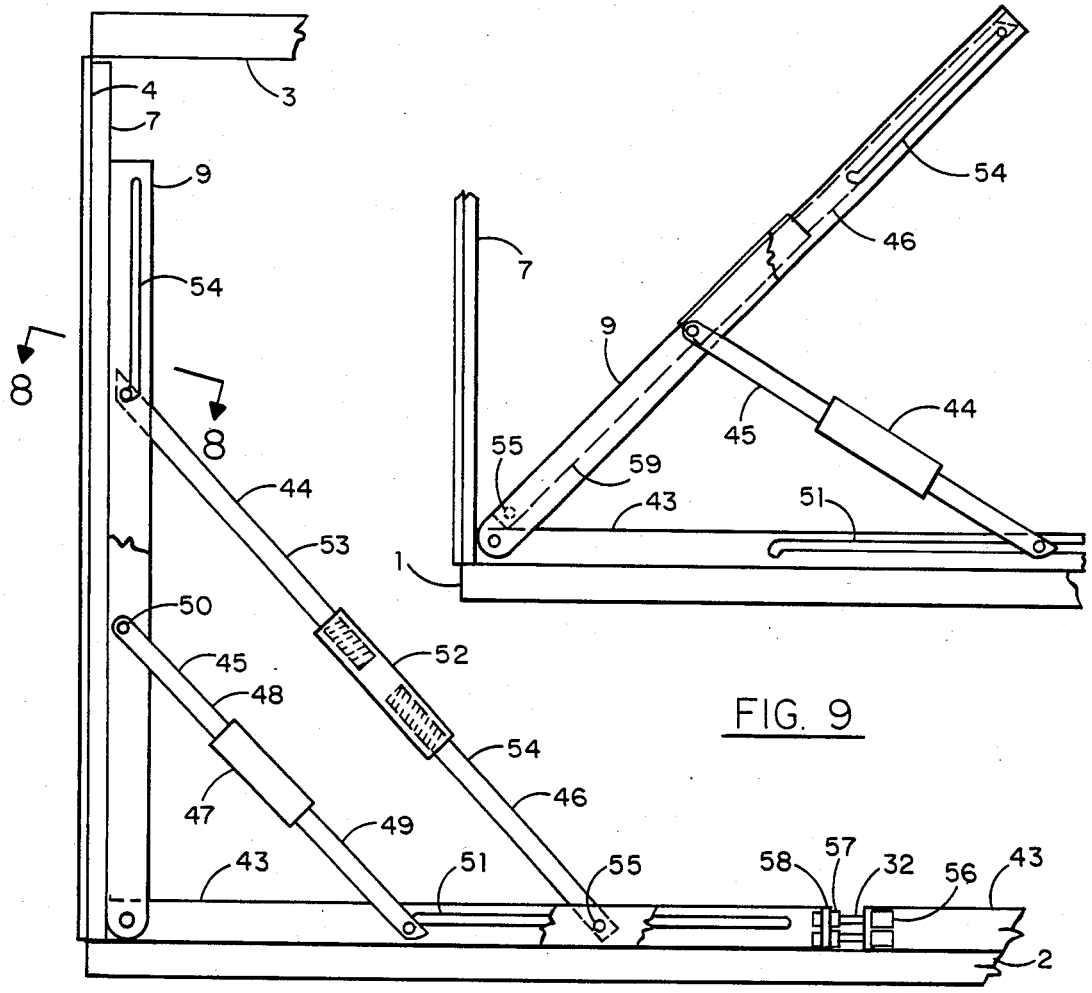
FIG. 9
FIG. 7

OMNIFORM BUILDING SYSTEM

BACKGROUND OF THE INVENTION

This invention relates generally to multi-story building structures, and more specifically to the prefabricated modules used in their construction.

The prior art indicates many ways of prefabricating units at the factory, for subsequent transport to the building site. Typical of room elements partially complete, requiring support during transport and further work at the site are U.S. Pat. Nos. 3,848,952 to Hanaoka on Nov. 26, 1974, 3,940,903 to Gunkel on Mar. 2, 1976, 4,023,315 to Stucky on May 17, 1977, and 4,045,937 to Stucky on Sept. 6, 1977. Several other disclosures involve complete structural enclosures ready for transport and installation at the site. They are U.S. Pat. Nos. 3,751,864 to Berger on Aug. 14, 1973, 3,757,477 to McCrillis on Sept. 11, 1973, and 3,990,193 to Ray on Nov. 9, 1976.

The first group describes units requiring further work, and therefore cannot have finished interiors. The second group involves structurally complete units, which are of necessity very heavy.

The present invention provides a very light prefabricated module which is completely finished inside, but still has the structural integrity for installation into a multi-story building. This is accomplished through the use of a collapsible, soft-faced internal bracing system, which allows the vertical walls to contain very little structure beyond the internal finished material.

A primary object, therefore, is to provide a structural module that allows a maximum amount of pre-fabrication to be done before transporting to the building site.

A further object is to design an internal bracing system that cooperates with a light construction module to resist transporting and erection loads.

Another object is the provision of a living unit of minimum weight that can be craned to the upper floors of a multi-story building.

A still further object is to develop a bracing system that can be collapsed and reused on many subsequent modules.

Still another object is to provide a system for internal bracing that does not damange finished walls and floors.

A final object is to provide a structural module whose floor, sides and ceiling can be poured contiguously and raised into position while connected.

SUMMARY OF THE INVENTION

The Omniform building system involves the fabrication and finishing of modular living spaces such as a hotel room or an apartment unit. A simple box structure is described relative to the system of fabrication and assembly, but the finished unit may contain a bathroom or kitchen. One way this may be accomplished is through the use of my U.S. Pat. No. 4,447,996, issued May 15, 1984 to Maurer, Baumann and Watkins. In that disclosure a completed sub-unit cubicle is replaced by removal through an exterior opening and a new cubicle is rolled into place through the balcony opening of a previously installed module.

The removable interior bracing system is designed so that prefinished inside surfaces will not be damaged during transport, erection and on-site concrete placement of bearing-shear walls between units. When craned into place, the module with reinforcing steel attached, will normally be positioned 6½" from an adjacent unit and concrete poured into the resulting void. During pouring, the wet concrete exerts a maximum lateral load of about 1500 pounds per square foot, depending on the pouring rate. After curing, the wall has a minimum two-hour fire rating, an acceptable acoustical insulation rating and sufficient bearing and shear strength for a building of 160 feet in height, in seismic zones 3 and 4. The outside wall for end units, when installed at the building site, may be poured into a space-frame cored wall as described in my U.S. Pat. No. 3,407,560 issued Oct. 29, 1968.

When concrete walls and ceiling are prefabricated, they may be poured in a contiguous position with interconnecting hinges in place. Light-weight concrete of one inch thickness may contain long fibres to increase the bending and tensile strength. Complete wallpapering and painting can be done on the panels while in horizontal position and easily accessible. The walls and ceiling are hinged up into position, with the pouring forms still in place as a "strongback", if required. Internal soft-faced bracing is erected to support the walls after the forms are removed. Other materials such as ⅝" type X gypsum board may be used for the walls and ceiling, in which case light metal furring channels are placed on 16 inch centers for drywall attachment and support of the reinforcement steel.

The internal bracing system is made up of a multiplicity of light sections for ease of handling. Generally, two flat vertical panels of about 3 feet in width are placed against opposing vertical walls of the module. An adjustable tubular bracing assembly is unfolded against each panel, and the two assemblies are placed against each other at the lateral center of the room. Extension of the tube lengths presses outwardly against both vertical panels and supports the thin walls during transport and erection at the site. Other similar sections are added through the length of the module and knock-down furniture, drapes, etc. can be placed inside, to be available when needed.

After the module has been placed in position on the building structure, and both side walls have been poured and cured, each bracing section is removed by collapsing the tubular assemblies and passing them out of a balcony or down a stairwell.

Additional features of the invention will become apparent from the preferred embodiment described in further detail.

BRIEF DESCRIPTION OF THE DRAWINGS

In the accompanying drawings:

FIG. 7 is an end view of another alternate bracing system, taken along plane 4—4 in FIG. 1.

FIG. 8 is a slant section taken along lines 8—8 in FIG. 7.

FIG. 9 is similar to FIG. 7, with the bracing system partially collapsed.

DETAILED DESCRIPTION OF A PREFERRED EMBODIMENT

The prefabricated module of my invention can be essentially completed at the factory. Since it will receive temporary internal bracing during transport and erection, the module can have thin vertical walls. After a crane has placed the module adjacent another unit at the site, the space between walls is filled with concrete to provide structural integrity. After the concrete has cured, the internal bracing is removed by collapsing and passing it through a doorway in the module.

A preferred method of constructing the module will also be described in detail, but it is not the only way to manufacture the unit. Any combination of materials that provides vertical walls incapable of withstanding a uniform side load of 15 pounds per square foot would benefit from my invention. This load is estimated as the average wind load encountered during transport to the site.

Three designs are shown for an internal bracing system. Each has some features that are desirable for ease of erection, simplicity or lightness.

Figure 1:
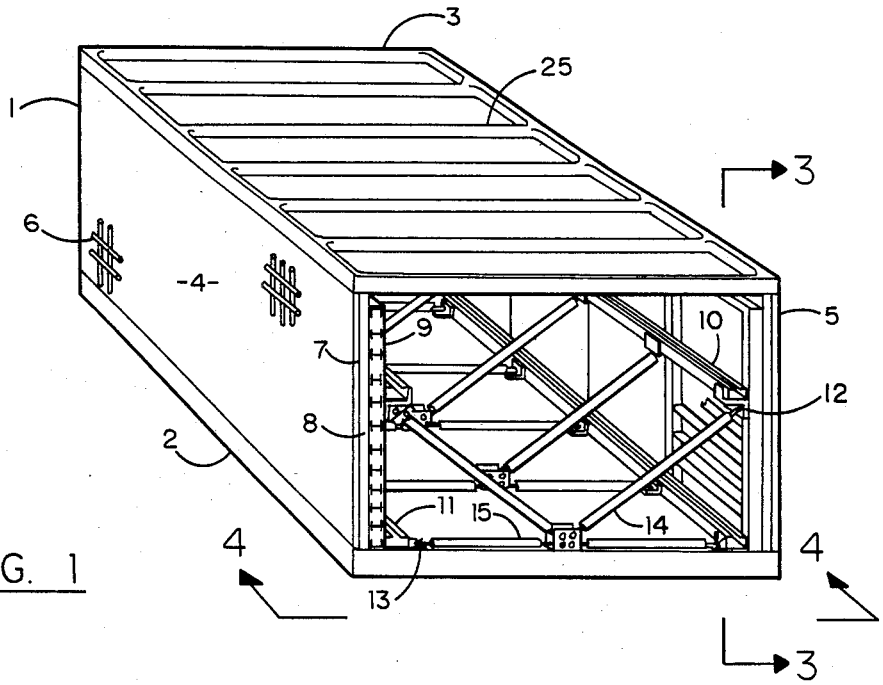
FIG. 1 is a parallel perspective drawing of a completed module with bracing of the preferred embodiment in place.

Turning now to the drawings, FIG. 1 shows a completed module 1, with end wall removed for clarity. An internal bracing system is shown in place, ready for transporting and craning. Module 1 consists of cast floor panel 2, cast ceiling panel 3 and vertical walls 4 and 5. These walls can be fabricated from gypsum board or cast of light weight concrete. Welded wire fabric 6 is attached to the outer surface of walls 4 and 5, and serves to bind the walls to the final concrete wall poured on erection at the site.

Figure 4:
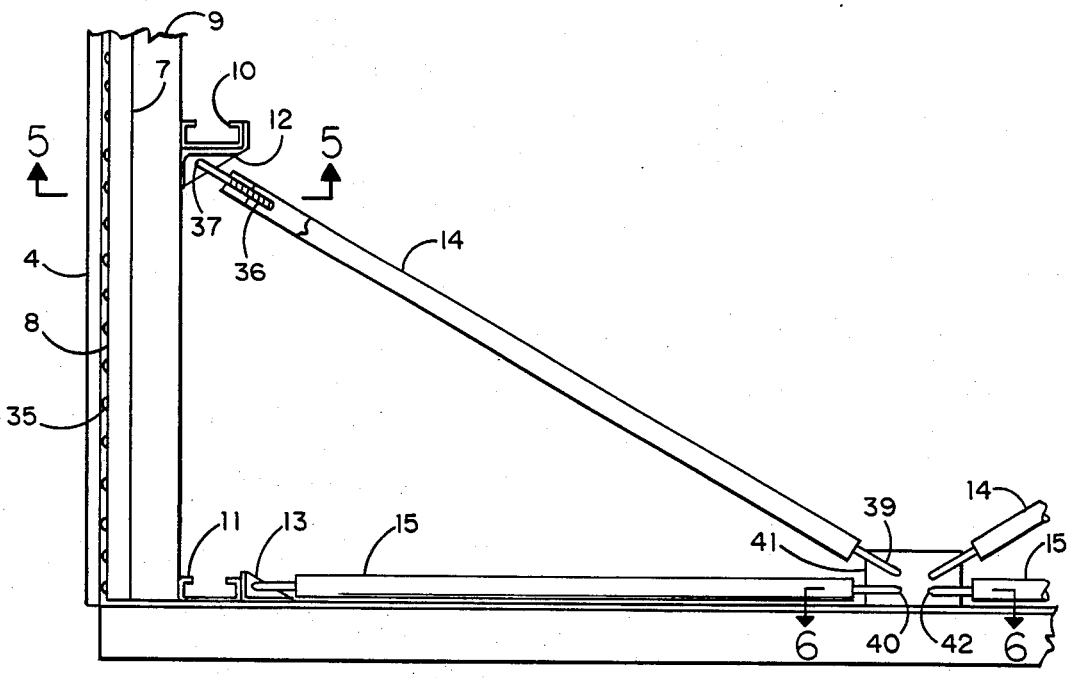
FIG. 4 shows an end view of the preferred bracing system, taken along plane 4—4 in FIG. 1.

Module 1 can have the inner surfaces completed, including wallpaper and carpeting. To protect these surfaces during handling, honeycomb door panels 7 have outer surface 8 padded by a material such as bubble-formed polyethylene. These door panels are light and inexpensive, but are not strong enough in bending to support the thin vertical walls. Structural frames 9 are placed against the inside surface of door panels 7, and aligned by channels 10 and 11 extending the entire length of module 1. These channels are supported by fittings 12 and 13, cooperating with tubular braces 14 and 15. Details of this bracing assembly are best seen in FIG. 4.

Figure 2:
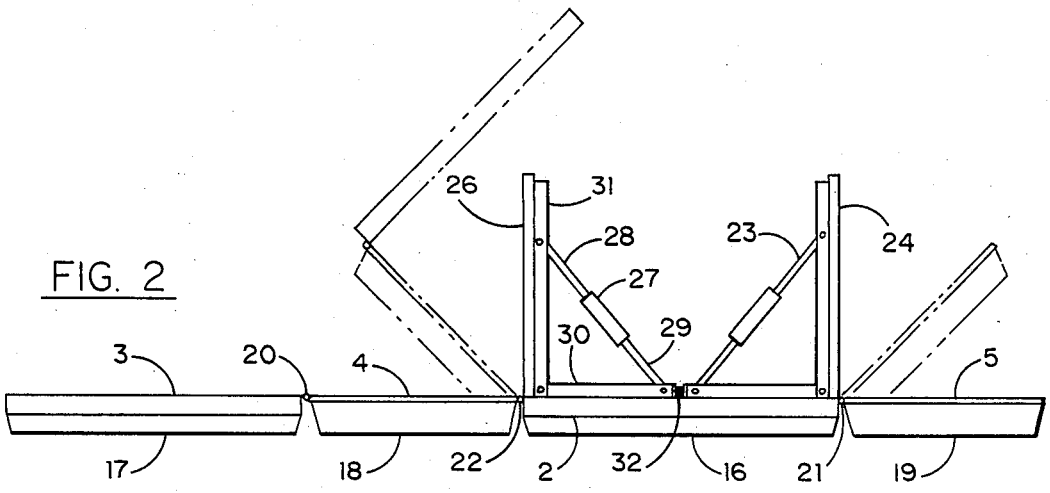
FIG. 2 is an end view of the preferred construction as cast, with partial wall erection positions shown in phantom. An alternate bracing system is shown ready to accept the walls when erected.

A method of construction for module 1 is shown in FIG. 2. Forms for pouring light-weight concrete are aligned horizontally, including floor form 16, ceiling form 17 and wall forms 18 and 19. Wall 14 and ceiling panel 3 are poured and interconnected by hinges 20. Wall 5 and floor panel 2 are poured and interconnected by hinges 21. Wall 4 is also connected to floor panel 2 by hinges 22.

After curing of the concrete, finish treatment such as wallpaper and carpeting can be applied to the upper surfaces of the four panels, while they are easily accessible. Wall-bracing system 23 is erected above floor panel 2 and wall 5 is hinged into an upright position against vertical panel 24 of bracing system 23. Since wall 5 is very thin, form 19 remains connected to wall 5 until it is in place against panel 24, then removed. Ceiling panel 3 is hinged out of form 17 into an upright position, since it is stiffened by transverse ribs 25, best seen in FIG. 1. Wall 4, together with form 18, is hinged into an upright position against vertical panel 26, thus placing ceiling panel 3 into position for attaching the free end to the top of wall 5. Rotatable sleeves 27 cooperate with oppositely threaded ends of tubes 28 and 29 to form an adjustable diagonal member as part of wall-bracing system 23. The lower ends of tubes 29 are attached to horizontal transverse member 30, and the upper ends of tubes 28 are fastened to vertical structural member 31. A multiplicity of these assemblies makes up bracing system 23, along with many vertical panels 24 and 26. Transverse members 30 are adjustably connected by compression bolts 32, best seen in FIG. 7. When all adjustments of the bracing system have been made, the completed module is lifted out of floor form 16 and transported to the construction site.

Figure 3:
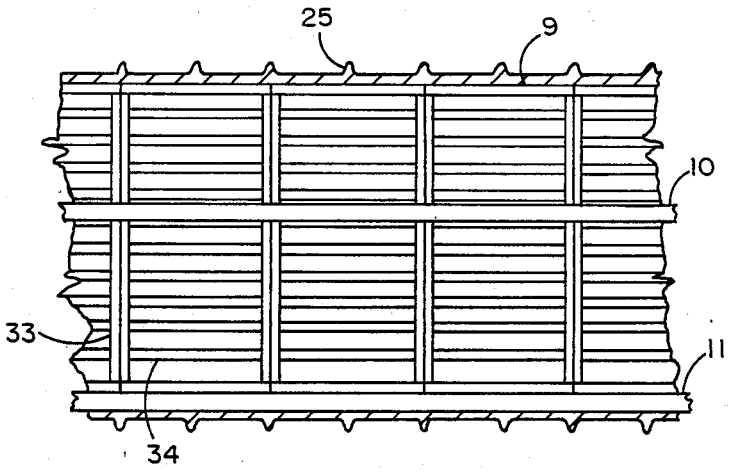
FIG. 3 is a sectional view taken along plane 3—3 in FIG. 1, showing the preferred well-bracing structure and ceiling and floor ribbed sections.

FIG. 3 is a longitudinal sectional view taken along place 3—3 in FIG. 1, and shows the ribbed nature of cast floor panel 2 and ceiling panel 3. Structural frames 9 are shown to be held in alignment by longitudinal channels 10 and 11. Vertical longerons 33 are joined together by ribs 34, with all members being channel-shaped, and containing lightening holes wherever possible.

The bracing system shown in FIG. 4 is the preferred embodiment, and is also the one shown in FIG. 1. Honeycomb panel 7 has its outer surface 8 padded with bubble-formed polyethylene sheet 35 to protect the inner surface of wall 4. Structural frame 9 is held against panel 7 by upper longitudinal channel 10 and lower channel 11. Upper fitting 12 supports channel 10 and is held captive to adjustable diagonal member 14 by threaded rod 36, since transverse shaft portion 37 passes through end fitting 12 and has an expanded end 38 on the far side of the fitting. This attachment is best seen in FIG. 5, and is also typical of the connection between horizontal tubular brace 15 and end fitting 13, which presses against lower longitudinal channel 11.

Threaded rods 39 extend from the opposite, or inboard, ends of tubular braces 14 and 15. These rods also have transverse shaft portions 40, but longer and without an expanded end. The threads are opposite from those on rods 36, so that rotation of tubular braces 14 and 15 changes the distance between the transverse shaft portions at opposite ends of the braces. Central fitting 41 has holes 42 which accept transverse shafts 40 but do not hold them captive.

Figure 5:
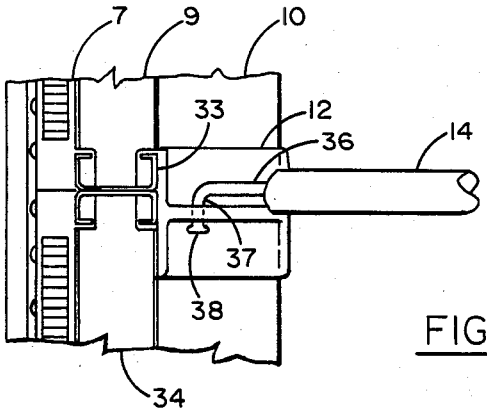
FIG. 5 is a sectional view looking upward along plane 5—5 in FIG. 4.

Further details of the attachment of tubular brace 14 to end fitting 12 are shown in FIG. 5. Threaded rod 36 is seen to have shaft portion 37 passing through fitting 12, and to have expanded end 38 holding it captive thereto. Channel 10 is shown pressing against structural frame 9, made up of longerons 33 and horizontal ribs 34. Door panels 7 are sectioned to show the honeycomb centers.

Figure 6:
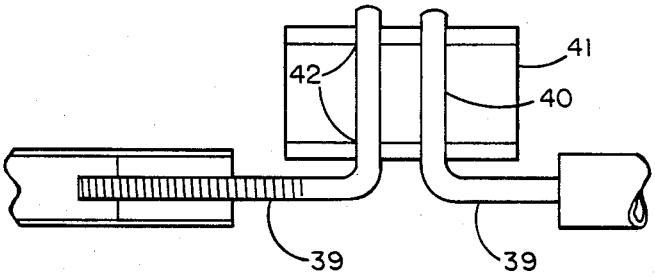
FIG. 6 is a sectional view looking downward along plane 6—6 in FIG. 4.

FIG. 6 shows further details of the connections between central fitting 41 and threaded rods 39. Transverse shaft portion 40 indexes into holes 42, but can easily be withdrawn for removal of the bracing system from module 1. The use of two holes per shaft in fitting 41 provides stability of the connection during load transfer between braces. A third and higher diagonal brace could be added if required to spread the transverse load during erection.

An alternate bracing system is shown in FIG. 7, with wall 4 reinforced by vertical door panel 7, held in place by structural frame 9. The vertical longerons of frame 9 are slotted at their upper ends and hinged to horizontal members 43 at their lower ends. Two adjustable diagonal tube assemblies are shown, although collapsible bracing section 44 could function with only one. Tube assemblies 45 and 46 are similar to those shown in FIG. 2. In the case of inner assembly 45, rotatable sleeve 47 cooperates with oppositely threaded ends of tubes 48 and 49 to provide adjustable length. Upper tube 48 has rotatable attachment 50 to frame 9, and lower tube 49 has a slidable attachment to horizontal linear member 43 by indexing into slot 51 in member 43. The outboard end of slot 51 is widened on the lower side to provide a locking position for tube 49. Outer tube assembly 46 has rotatable sleeve 52 providing adjustment with oppositely threaded ends of tubes 53 and 54. In this case, lower tube 54 has rotatable attachment 55 to linear member 43, but to the opposite flange. Upper tube 53 has a slidable attachment to frame 9 by indexing into slot 54 in the longeron of adjacent frame 9. The lower end of slot 54 is widened on the outboard side to provide locking for tube 53. These attachments are also shown in slant section in FIG. 8, taken along lines 8—8 in FIG. 7.

Horizontal members 43 are adjustably connected at the module center line by compression bolts 32, previously identified in FIG. 2. Nuts 56 are welded to right side member 43 on the near side only. Bolts 32 cooperate with locknuts 57 to hold flanges 58 into position. On the far side of members 43, the assembly is reversed, with nuts 56 welded to left side member 43. This arrangement allows all bracing sections to be interchangeable.

In FIG. 8, outer wall 4 and door panels 7 are shown at the top. Structural frames 9 are shown to be made up of longerons 33 and ribs 34, as previously shown in FIG. 3. Inner tube assembly 45 is shown to have a rotatable attachment 50 to longeron 33 of frame 9 on the right, while outer tube assembly 46 has a slidable attachment to longeron 33 of frame 9 on the left, through slot 54.

FIG. 9 shows the bracing section 44 of FIG. 7 partially collapsed for removal from module 1. To accomplish this, rotatable attachment 55 of outer tube assembly 46 is removed from member 43, and assembly 46 is slid up into slot 54 and pivoted into position 59. The lower end of inner tube assembly 45 is then slid horizontally in slot 51 as frame 9 is hinged into a horizontal position about the outer end of member 43. Door panels 7 are removed separately, since they are not connected to structural frames 9. This allows each portion of the bracing section 44 to be lighter and easier to handle.

When prefabricated modules 1 are awaiting erection at the site of a multistory building, their vertical walls are always supported from inside by a multiplicity of internal bracing systems. During installation, a module is placed approximately $6\frac{1}{2}''$ from an existing module, and concrete is poured between the adjacent walls. After the concrete has cured, the internal bracing sections are collapsed within the previously existing module, and removed through one end, either balcony or stairwell. The bracing in the newly-placed module is kept in place until another module is placed adjacent the opposite wall, and concrete is poured to form that wall. In the case of an end unit, module 1 is placed approximately $6\frac{1}{2}$ inches from an existing module at a desired location for an outside wall. In this case, a vertical form must be erected at the outer surface location for the wall, and concrete poured between adjacent walls of the modules, and inside the outside wall form. The internal bracing sections can then be removed after the concrete has cured. An alternate method is the use of a space frame cored wall into which the concrete is poured.

As can be seen from the foregoing description, a structural module has been disclosed that can have all inside surfaces completely finished at the factory, and yet can remain light enough to be transported and erected easily, including knock-down furniture if desired. Several versions of a removable internal bracing system have been presented, as well as a simplified method of constructing the module at the factory. In order to comply with the statute, this invention has been described in considerable detail, but it should be understood that these details are subject to variations apparent to those skilled in the art. The invention is, therefore, not to be limited in scope, except as indicated by the extent of the claims.

I claim:

1. As a lightweight transportable unit, the combination of a prefabricated building module and a collapsible internal bracing system; said module comprising at least two vertical walls having inner surfaces and a floor and ceiling, said bracing system including separate vertical panels, said panels extending over substantially all of the inner surfaces of said vertical walls, said walls of about one inch of concrete thickness and said inner surfaces of said walls having a layer of finished material applied thereto.

2. A method of constructing a transportable, internally braced building module, including the steps of:

a. aligning horizontal forms for a floor, two walls and a ceiling,
b. fabricating said floor, walls and ceiling, including hinged connections,
c. applying finish treatment to upper surfaces of said floor, walls and ceiling,
d. erecting a removable wall-bracing system on said floor,
e. hinging the first of said walls into upright position against one side of said bracing system,
f. hinging said celling into upright position,
g. hinging the second of said walls against the other side of said bracing system while said ceiling remains connected to said second wall,
h. attaching the free end of said ceiling to the top of said first wall, and
i. adjusting said wall-bracing system to provide structural support to said walls.

3. The invention in claim 1, wherein said vertical panels have cushioning over substantially all of their outer surfaces.

4. The invention in claim 3, wherein said bracing system comprises a multiplicity of sections, each of said sections including one of said vertical panels, a horizontal transverse member and at least one adjustable diagonal member, said vertical panels being held in place by said horizontal and said diagonal members.

5. The invention in claim 4, wherein said adjustable diagonal member comprises a rotatable tube threaded on at least one end, said tube end engaging a threaded rod having a transverse shaft, said shaft passing through an end fitting, said fitting being held captive by an expanded end on said shaft.

6. The invention in claim 4, wherein said vertical panels are reinforced by a structural frame held in contact therewith by said horizontal and said diagonal members.

7. The invention in claim 6, wherein said structural frame is aligned with a multiplicity of other structural frames by contact with at least one longitudinal horizontal structural member.

8. In a multi-story building made up of prefabricated modules, the method of:

placing a thin-walled module a desired wall thickness from an existing thin-walled module, inner surfaces of said modules having a layer of finished material applied thereon and outer surfaces of said modules having reinforcing steel attached thereto, said modules having their vertical walls supported from inside by a multiplicity of separate internal bracing sections engaging substantially all of the inner surface, pouring concrete to fill the space between adjacent walls of said modules and to contain said reinforcing steel, allowing curing time for said concrete, collapsing the internal bracing sections within said existing module, and removing said bracing sections through one end of said existing module.

* * * * *